US011649999B2

(12) United States Patent
Shi

(10) Patent No.: US 11,649,999 B2
(45) Date of Patent: May 16, 2023

(54) DIRECT COOLING ICE MAKER WITH COOLING SYSTEM

(71) Applicant: Electrolux Home Products, Inc., Charlotte, NC (US)

(72) Inventor: Zhuochen Shi, Clemson, SC (US)

(73) Assignee: Electrolux Home Products, Inc., Charlotte, NC (US)

( * ) Notice: Subject to any disclaimer, the term of this patent is extended or adjusted under 35 U.S.C. 154(b) by 46 days.

(21) Appl. No.: 17/320,780

(22) Filed: May 14, 2021

(65) Prior Publication Data

US 2022/0364778 A1 Nov. 17, 2022

(51) Int. Cl.

| | |
|---|---|
| ***F25C 1/246*** | (2018.01) |
| ***F25C 5/20*** | (2018.01) |
| ***F25C 1/04*** | (2018.01) |
| ***F25C 5/185*** | (2018.01) |

(52) U.S. Cl.

CPC ..... *F25C 1/246* (2013.01); *F25C 1/04* (2013.01); *F25C 5/185* (2013.01); *F25C 5/22* (2018.01); *F25C 2400/10* (2013.01)

(58) Field of Classification Search

CPC .... F25C 1/246; F25C 5/22; F25C 1/04; F25C 2400/10; F25D 11/022

See application file for complete search history.

(56) References Cited

U.S. PATENT DOCUMENTS

| | | | |
|---|---|---|---|
| 6,591,619 | B2 | 7/2003 | Kaneko et al. |
| 6,672,089 | B2 | 1/2004 | Park et al. |
| 6,775,998 | B2 | 8/2004 | Yuasa et al. |
| 6,865,900 | B2 | 3/2005 | Ozawa et al. |
| 7,316,384 | B2 | 1/2008 | Sekiya et al. |
| 7,437,888 | B2 | 10/2008 | Son et al. |
| 7,637,116 | B2 | 12/2009 | Park |
| 7,934,695 | B2 | 5/2011 | Sim et al. |
| 8,479,527 | B2 | 7/2013 | Song et al. |
| 8,499,573 | B2 | 8/2013 | Oh et al. |
| 8,635,880 | B2 | 1/2014 | Jeong et al. |
| 8,720,222 | B2 | 5/2014 | Cur et al. |
| 8,844,569 | B2 | 9/2014 | Lin et al. |
| 9,103,569 | B2 | 8/2015 | Cur et al. |
| 9,562,707 | B2 | 2/2017 | Wu |

(Continued)

OTHER PUBLICATIONS

Co-pending U.S. Appl. No. 16/681,931.
Co-pending U.S. Appl. No. 16/710,250.

*Primary Examiner* — Elizabeth J Martin
(74) *Attorney, Agent, or Firm* — Peame & Gordon LLP

(57) ABSTRACT

A refrigeration appliance includes a fresh food compartment for storing food items in a refrigerated environment having a target temperature above 0° C., a freezer compartment for storing food items in a sub-freezing environment having a target temperature below 0° C., a system evaporator for providing a cooling effect to at least one of the fresh food compartment and the freezer compartment, and an ice maker disposed within the fresh food compartment for freezing water into ice pieces. The ice maker includes an ice mold with an upper surface comprising a plurality of cavities formed therein for the ice pieces, a heater disposed on the ice mold and an ice maker refrigerant tube abutting at least one lateral side surface of the ice mold and cooling the ice mold to a temperature below 0° C. via thermal conduction.

15 Claims, 11 Drawing Sheets

(56) References Cited

U.S. PATENT DOCUMENTS

| | | | | |
|---|---|---|---|---|
| 9,605,884 | B2 | 3/2017 | Gomes et al. | |
| 9,746,087 | B2 | 8/2017 | Yokoe et al. | |
| 9,777,956 | B2 | 10/2017 | Lee et al. | |
| 9,933,188 | B2 | 4/2018 | Lim et al. | |
| 9,970,698 | B2 | 5/2018 | Gomes et al. | |
| 10,041,716 | B2 | 8/2018 | Lee et al. | |
| 10,077,932 | B2 | 9/2018 | Yoon et al. | |
| 10,082,326 | B2 | 9/2018 | Kim et al. | |
| 10,082,330 | B2 | 9/2018 | Chung et al. | |
| 10,088,216 | B2 | 10/2018 | Chae et al. | |
| 10,161,665 | B2 | 12/2018 | Wu | |
| 10,197,324 | B2 | 2/2019 | Lee et al. | |
| 10,203,139 | B2 | 2/2019 | Kobayashi et al. | |
| 10,203,144 | B2 | 2/2019 | Kilinc et al. | |
| 10,514,194 | B2 | 12/2019 | Avhale et al. | |
| 10,539,354 | B2 | 1/2020 | Shi et al. | |
| 10,712,074 | B2 | 7/2020 | Scalf et al. | |
| 10,746,444 | B2 | 8/2020 | Kim | |
| 10,746,455 | B2 | 8/2020 | Kim | |
| 10,873,479 | B2 | 12/2020 | Hampel et al. | |
| 2007/0033962 | A1 | 2/2007 | Kang et al. | |
| 2007/0137230 | A1 | 6/2007 | Bae et al. | |
| 2018/0347885 | A1* | 12/2018 | Avhale | F25B 49/02 |
| 2019/0178557 | A1 | 6/2019 | Chung et al. | |
| 2019/0178559 | A1 | 6/2019 | Lee et al. | |
| 2019/0178560 | A1 | 6/2019 | Lee et al. | |
| 2019/0186803 | A1 | 6/2019 | Seong et al. | |
| 2019/0195543 | A1* | 6/2019 | Shi | F25C 5/182 |
| 2020/0080759 | A1 | 3/2020 | Shi et al. | |
| 2020/0109886 | A1 | 4/2020 | Shi et al. | |
| 2020/0256601 | A1 | 8/2020 | Kim | |
| 2020/0333059 | A1 | 10/2020 | Kim | |
| 2020/0340729 | A1 | 10/2020 | Scalf et al. | |

* cited by examiner

DIRECT COOLING ICE MAKER WITH COOLING SYSTEM

CROSS-REFERENCE TO RELATED APPLICATIONS

Not Applicable

FIELD OF THE INVENTION

This application relates generally to an ice maker for a refrigeration appliance, and more particularly, to a refrigeration appliance including a direct cooling ice maker and a cooling system for the same.

BACKGROUND OF THE INVENTION

Conventional refrigeration appliances, such as domestic refrigerators, typically have both a fresh food compartment and a freezer compartment or section. The fresh food compartment is where food items such as fruits, vegetables, and beverages are stored and the freezer compartment is where food items that are to be kept in a frozen condition are stored. The refrigerators are provided with a refrigeration system that maintains the fresh food compartment at temperatures above 0° C., such as between 0.25° C. and 4.5° C. and the freezer compartments at temperatures below 0° C., such as between 0° C. and −20° C.

The arrangements of the fresh food and freezer compartments with respect to one another in such refrigerators vary. For example, in some cases, the freezer compartment is located above the fresh food compartment and in other cases the freezer compartment is located below the fresh food compartment. Additionally, many modern refrigerators have their freezer compartments and fresh food compartments arranged in a side-by-side relationship. Whatever arrangement of the freezer compartment and the fresh food compartment is employed, typically, separate access doors are provided for the compartments so that either compartment may be accessed without exposing the other compartment to the ambient air.

Such conventional refrigerators are often provided with a unit for making ice pieces, commonly referred to as "ice cubes" despite the non-cubical shape of many such ice pieces. These ice making units normally are located in the freezer compartments of the refrigerators and manufacture ice by convection, i.e., by circulating cold air over water in an ice tray to freeze the water into ice cubes. Storage bins for storing the frozen ice pieces are also often provided adjacent to the ice making units. The ice pieces can be dispensed from the storage bins through a dispensing port in the door that closes the freezer to the ambient air. The dispensing of the ice usually occurs by means of an ice delivery mechanism that extends between the storage bin and the dispensing port in the freezer compartment door.

However, for refrigerators such as the so-called "bottom mount" refrigerator, which includes a freezer compartment disposed vertically beneath a fresh food compartment, placing the ice maker within the freezer compartment is impractical. Users would be required to retrieve frozen ice pieces from a location close to the floor on which the refrigerator is resting. And providing an ice dispenser located at a convenient height, such as on an access door to the fresh food compartment, would require an elaborate conveyor system to transport frozen ice pieces from the freezer compartment to the dispenser on the access door to the fresh food compartment. Thus, ice makers are commonly included in the fresh food compartment of bottom mount refrigerators, which creates many challenges in making and storing ice within a compartment that is typically maintained above the freezing temperature of water.

There is provided a cooling system for an ice maker including an evaporator coil in direct contact with an ice tray of the ice maker for cooling the ice tray.

BRIEF SUMMARY OF THE INVENTION

In accordance with one aspect, there is provided a refrigeration appliance including a fresh food compartment for storing food items in a refrigerated environment having a target temperature above 0° C., a freezer compartment for storing food items in a sub-freezing environment having a target temperature below 0° C., an ice maker disposed within the fresh food compartment for freezing water into ice pieces, and a valve. The ice maker includes an ice mold with an upper surface comprising a plurality of cavities formed therein for the ice pieces. An ice maker evaporator cools the ice mold to a temperature below 0° C. via thermal conduction. The ice maker includes a cooling system having a fresh food evaporator, an ice box evaporator tube and a freezer evaporator all disposed in series with the ice maker evaporator. A valve includes an inlet, a first outlet connected to an inlet of the fresh food evaporator, a second outlet connected to a first bypass line around the fresh food evaporator, and a third outlet connected to a second bypass line around the fresh food evaporator and the ice maker evaporator. The inlet of the valve is connected to the first outlet of the valve when the valve is in a first position such that a refrigerant flows through the fresh food evaporator, the ice maker evaporator, the ice box evaporator tube and the freezer evaporator, in that order. The inlet of the valve is connected to the second outlet of the valve when the valve is in a second position such that the refrigerant flows through the first bypass line, the ice maker evaporator, the ice box evaporator tube and the freezer evaporator, in that order. The inlet of the valve is connected to the third outlet of the valve when the valve is in a third position such that the refrigerant flows through the second bypass line, the ice box evaporator tube and the freezer evaporator, in that order.

In the refrigeration appliance, the ice maker evaporator abutting at least one lateral side surface of the ice mold.

In the refrigeration appliance, the first bypass line connects to a line connecting the fresh food evaporator to the ice maker evaporator at a location upstream of the ice maker evaporator.

In the refrigeration appliance, the second bypass line connects to a line connecting the ice maker evaporator to the ice box evaporator tube at a location upstream of the ice box evaporator tube.

In the refrigeration appliance, the valve is a stepper valve.

In accordance with another aspect, there is provided a refrigeration appliance including a fresh food compartment for storing food items in a refrigerated environment having a target temperature above 0° C., a freezer compartment for storing food items in a sub-freezing environment having a target temperature below 0° C., an ice maker disposed within the fresh food compartment for freezing water into ice pieces, and a valve. The ice maker includes an ice mold comprising at least one cavity formed therein for making the ice pieces. An ice maker evaporator cools the ice mold to a temperature below 0° C. via thermal conduction. The ice maker includes a cooling system having a fresh food evaporator. An ice box evaporator tube and a freezer evaporator both are disposed in series with the ice maker evaporator. A valve includes an inlet, a first outlet connected to an inlet of the fresh food evaporator, a second outlet connected to an inlet of the ice maker evaporator, and a third outlet connected to a bypass line around the fresh food evaporator and the ice maker evaporator. The inlet of the valve is connected to the first outlet of the valve when the valve is in a first position such that a refrigerant flows through the fresh food evaporator, the ice box evaporator tube and the freezer evaporator, in that order. The inlet of the valve is connected to the second outlet of the valve when the valve is in a second position such that the refrigerant flows through the ice maker evaporator, the ice box evaporator tube and the freezer evaporator, in that order. The inlet of the valve is connected to the third outlet of the valve when the valve is in a third position such that the refrigerant flows through the bypass line, the ice box evaporator tube and the freezer evaporator, in that order.

In the refrigeration appliance, the ice maker evaporator abutting at least one lateral side surface of the ice mold.

In the refrigeration appliance, the bypass line connects to a line connecting the ice maker evaporator to the ice box evaporator tube at a location upstream of the ice box evaporator tube.

In the refrigeration appliance, when the valve is in the first position the fresh food evaporator fluidly communicates with a line connecting the ice maker evaporator to the ice box evaporator tube at a location upstream of the ice box evaporator tube.

In the refrigeration appliance, the valve is a stepper valve.

In accordance with yet another aspect, there is provided a cooling system for a refrigeration appliance. The cooling system includes a first evaporator for cooling water to a temperature below 0° C. via thermal conduction, a second evaporator, a third evaporator and a fourth evaporator both disposed in series with the first evaporator, and a valve. The valve includes an inlet, a first outlet connected to an inlet of the second evaporator, a second outlet fluidly connected to an inlet of the first evaporator; and a third outlet connected to a bypass line around the first evaporator and the second evaporator. The inlet of the valve is connected to the first outlet of the valve when the valve is in a first position such that a refrigerant flows through the second evaporator, the third evaporator and the fourth evaporator, in that order. The inlet of the valve is connected to the second outlet of the valve when the valve is in a second position such that the refrigerant flows through the first evaporator, the third evaporator and the fourth evaporator, in that order, but not through the second evaporator. The inlet of the valve is connected to the third outlet of the valve when the valve is in a third position such that the refrigerant flows through the bypass line, the third evaporator and the fourth evaporator, in that order, but not through the first evaporator and the second evaporator.

In the cooling system, the first evaporator is an ice maker evaporator.

In the cooling system, the second evaporator is a fresh food evaporator for a fresh food compartment. The fresh food compartment stores food items in a refrigerated environment having a target temperature above 0° C.

In the cooling system, the third evaporator is an ice box evaporator tube.

In the cooling system, the fourth evaporator is a freezer evaporator for a freezer compartment, the freezer compartment for storing food items in a sub-freezing environment having a target temperature below 0° C.

In the cooling system, the valve is a stepper valve.

In the cooling system, the second evaporator is in series with the first evaporator, the third evaporator and the fourth evaporator.

In the cooling system, the second outlet of the valve is connected to a refrigerant line that bypasses the second evaporator.

In the foregoing cooling system, the first evaporator is disposed in the refrigerant line.

In the foregoing cooling system, the refrigerant line connects to a second refrigerant line that connects an outlet of the second evaporator to an inlet of the first evaporator.

DESCRIPTION OF EXAMPLE EMBODIMENTS

Figure 1:
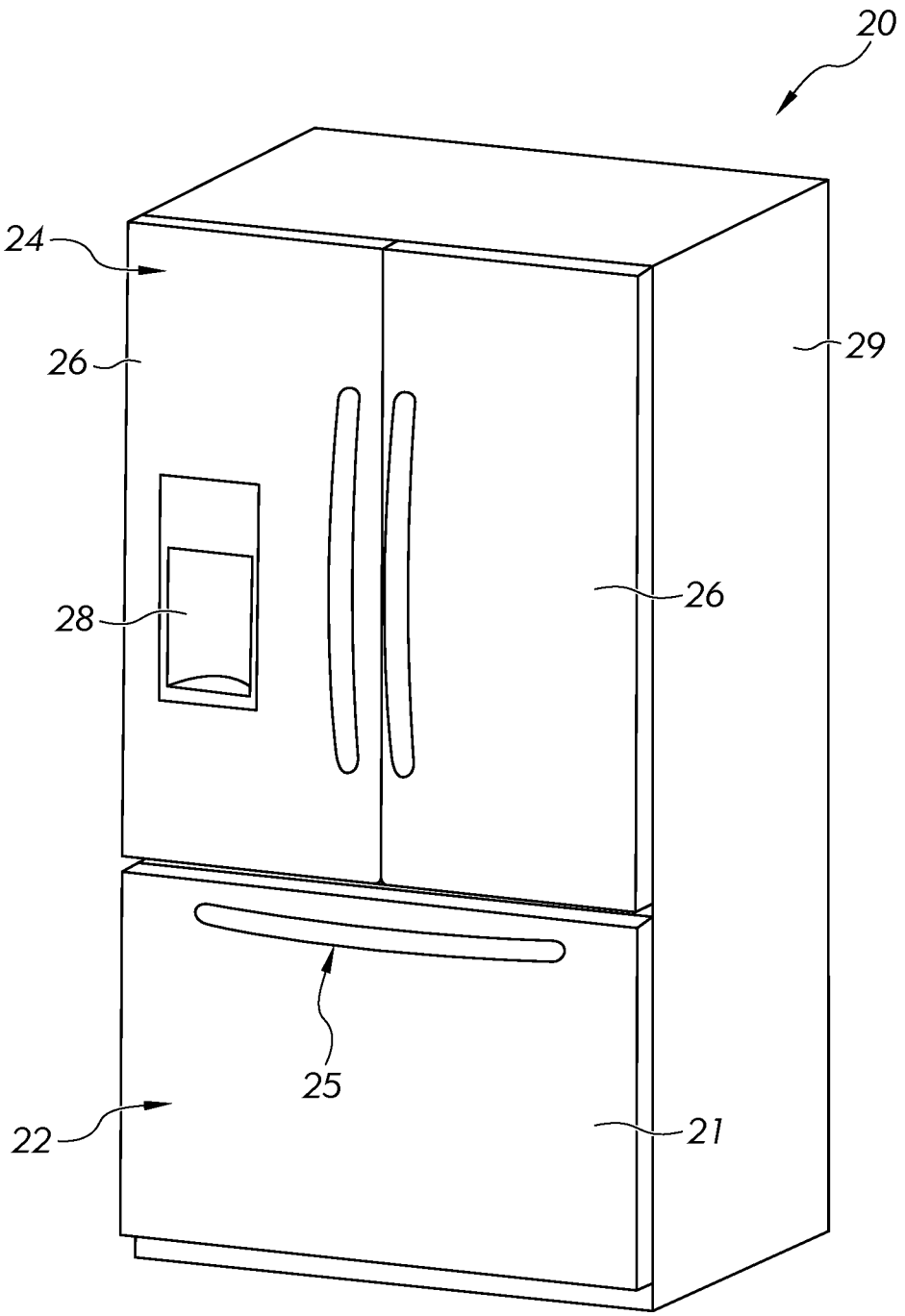
FIG. 1 is a front perspective view of a household French Door Bottom Mount showing doors of the refrigerator in a closed position.
Figure 2:
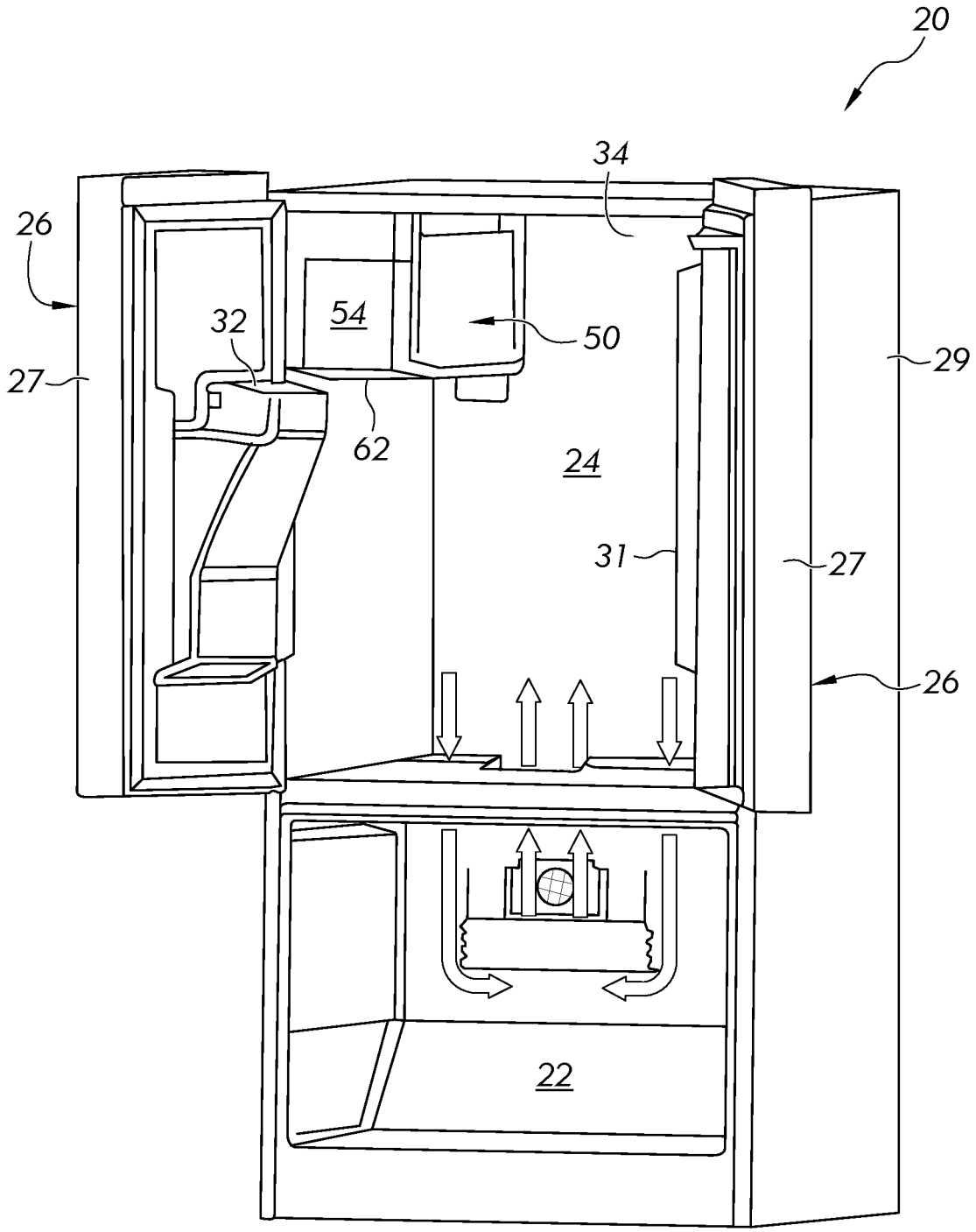
FIG. 2 is a front perspective view of the refrigerator of FIG. 1 showing the doors in an open position and an ice maker in a fresh food compartment.

Referring now to the drawings, FIG. 1 shows a refrigeration appliance in the form of a domestic refrigerator, indicated generally at 20. Although the detailed description that follows concerns a domestic refrigerator 20, the invention can be embodied by refrigeration appliances other than with a domestic refrigerator 20. Further, an embodiment is described in detail below, and shown in the figures as a bottom-mount configuration of a refrigerator 20, including a fresh food compartment 24 disposed vertically above a freezer compartment 22. However, the refrigerator 20 can have any desired configuration including at least a fresh food compartment 24 and an ice maker 50 (FIG. 2), such as a top mount refrigerator (freezer disposed above the fresh food compartment), a side-by-side refrigerator (fresh food compartment is laterally next to the freezer compartment), a standalone refrigerator or freezer, etc.

One or more doors 26 shown in FIG. 1 are pivotally coupled to a cabinet 29 of the refrigerator 20 to restrict and grant access to the fresh food compartment 24. The door 26 can include a single door that spans the entire lateral distance across the entrance to the fresh food compartment 24, or can include a pair of French-type doors 26 as shown in FIG. 1 that collectively span the entire lateral distance of the entrance to the fresh food compartment 24 to enclose the fresh food compartment 24. For the latter configuration, a center flip mullion 31 (FIG. 2) is pivotally coupled to at least one of the doors 26 to establish a surface against which a seal provided to the other one of the doors 26 can seal the entrance to the fresh food compartment 24 at a location between opposing side surfaces 27 (FIG. 2) of the doors 26. The mullion 31 can be pivotally coupled to the door 26 to pivot between a first orientation that is substantially parallel to a planar surface of the door 26 when the door 26 is closed, and a different orientation when the door 26 is opened. The externally-exposed surface of the center mullion 31 is substantially parallel to the door 26 when the center mullion 31 is in the first orientation, and forms an angle other than parallel relative to the door 26 when the center mullion 31 is in the second orientation. The seal and the externally-exposed surface of the mullion 31 cooperate approximately midway between the lateral sides of the fresh food compartment 24.

A dispenser 28 (FIG. 1) for dispensing at least ice pieces, and optionally water, can be provided on an exterior of one of the doors 26 that restricts access to the fresh food compartment 24. The dispenser 28 includes a lever, switch, proximity sensor or other device that a user can interact with to cause frozen ice pieces to be dispensed from an ice bin 54 (FIG. 2) of the ice maker 50 disposed within the fresh food compartment 24. Ice pieces from the ice bin 54 can exit the ice bin 54 through an aperture 62 and be delivered to the dispenser 28 via an ice chute 32 (FIG. 2), which extends at least partially through the door 26 between the dispenser 28 and the ice bin 54.

Referring to FIG. 1, the freezer compartment 22 is arranged vertically beneath the fresh food compartment 24. A drawer assembly (not shown) including one or more freezer baskets (not shown) can be withdrawn from the freezer compartment 22 to grant a user access to food items stored in the freezer compartment 22. The drawer assembly can be coupled to a freezer door 21 that includes a handle 25. When a user grasps the handle 25 and pulls the freezer door 21 open, at least one or more of the freezer baskets is caused to be at least partially withdrawn from the freezer compartment 22.

The freezer compartment 22 is used to freeze and/or maintain articles of food stored in the freezer compartment 22 in a frozen condition. For this purpose, the freezer compartment 22 is in thermal communication with a freezer evaporator 302 (FIGS. 8 and 9) that removes thermal energy from the freezer compartment 22 to maintain the temperature therein at a temperature of 0° C. or less during operation of the refrigerator 20, preferably between 0° C. and −50° C., more preferably between 0° C. and −30° C. and even more preferably between 0° C. and −20° C.

The refrigerator 20 includes an interior liner 34 (FIG. 2) that defines the fresh food compartment 24. The fresh food compartment 24 is located in the upper portion of the refrigerator 20 in this example and serves to minimize spoiling of articles of food stored therein. The fresh food compartment 24 accomplishes this by maintaining the temperature in the fresh food compartment 24 at a cool temperature that is typically above 0° C., so as not to freeze the articles of food in the fresh food compartment 24. It is contemplated that the cool temperature preferably is between 0° C. and 10° C., more preferably between 0° C. and 5° C. and even more preferably between 0.25° C. and 4.5° C. According to some embodiments, cool air from which thermal energy has been removed by the freezer evaporator 302 can also be blown into the fresh food compartment 24 to maintain the temperature therein greater than 0° C. preferably between 0° C. and 10° C., more preferably between 0° C. and 5° C. and even more preferably between 0.25° C. and 4.5° C. For alternate embodiments, a separate fresh food evaporator (not shown) can optionally be dedicated to separately maintaining the temperature within the fresh food compartment 24 independent of the freezer compartment 22. According to an embodiment, the temperature in the fresh food compartment 24 can be maintained at a cool temperature within a close tolerance of a range between 0° C. and 4.5° C., including any subranges and any individual temperatures falling with that range. For example, other embodiments can optionally maintain the cool temperature within the fresh food compartment 24 within a reasonably close tolerance of a temperature between 0.25° C. and 4° C.

Figure 3:
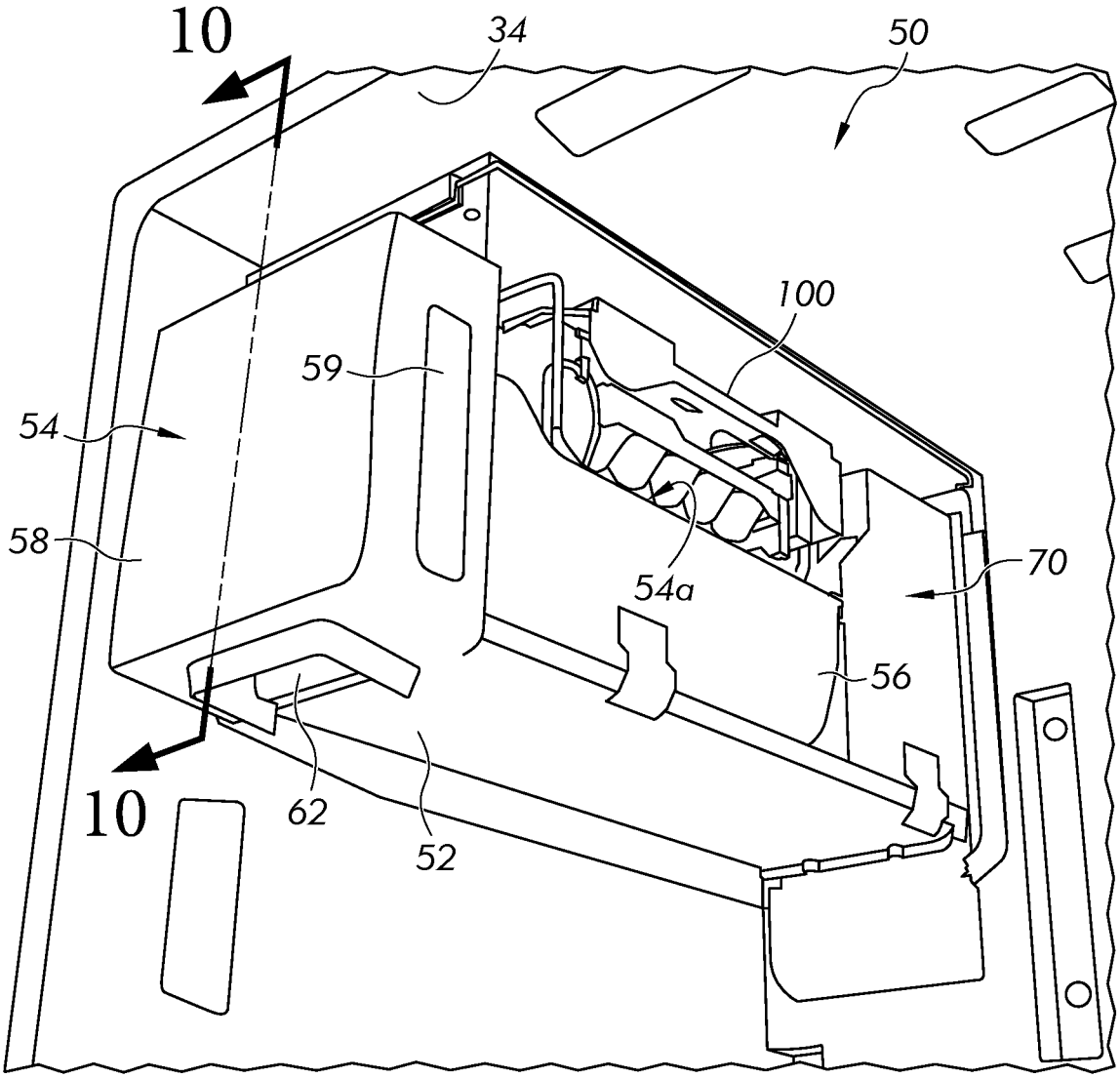
FIG. 3 is a side perspective view of an ice maker with a side wall of a frame of the ice maker removed for clarity.

An illustrative embodiment of the ice maker 50 is shown in FIG. 3. In general, the ice maker 50 includes a frame 52, an ice bin 54, an ice tray assembly 100 and an air handler assembly 70. The ice bin 54 stores ice pieces made by the ice tray assembly 100 and the air handler assembly 70 circulates cooled air to the ice tray assembly 100 and the ice bin 54. The ice maker 50 is secured within the fresh food compartment 24 using any suitable fastener. The frame 52 is generally rectangular-in-shape for receiving the ice bin 54. The frame 52 includes insulated walls for thermally isolating the ice maker 50 from the fresh food compartment 24. A plurality of fasteners (not shown) may be used for securing the frame 52 of the ice maker 50 within the fresh food compartment 24 of the refrigerator 20.

For clarity the ice maker 50 is shown with a side wall of the frame 52 removed; normally, the ice maker 50 would be enclosed by insulated walls. The ice bin 54 includes a housing 56 having an open, front end and an open top. A front cover 58 is secured to the front end of the housing 56 to enclose the front end of the housing 56. When secured together to form the ice bin 54, the housing 56 and the front cover 58 define an internal cavity 54*a* of the ice bin 54 used to store the ice pieces made by the ice tray assembly 100. The front cover 58 may be secured to the housing 56 by mechanical fasteners that can be removed using a suitable tool, examples of which include screws, nuts and bolts, or any suitable friction fitting possibly including a system of tabs allowing removal of the front cover 58 from the housing 56 by hand and without tools. Alternatively, the front cover 58 is non-removably secured in place on the housing 56 using methods such as, but not limited to, adhesives, welding, non-removable fasteners, etc. In various other examples, a recess 59 is formed in a side of the front cover 58 to define a handle that may be used by a user for ease in removing the ice bin 54 from the ice maker 50. An aperture 62 is formed in a bottom of the front cover 58. A rotatable auger (not shown) can extend along a length of the ice bin 54. As the auger rotates, ice pieces in the ice bin 54 are urged ice towards the aperture 62 wherein an ice crusher (not shown) is disposed. The ice crusher is provided for crushing the ice pieces conveyed thereto, when a user requests crushed ice. The augur can optionally be automatically activated and rotated by an auger motor assembly (not shown) of the air handler assembly 70. The aperture 62 is aligned with the ice chute 32 (FIG. 2) when the door 26 is closed. This alignment allows for the auger to push the frozen ice pieces stored in the ice bin 54 into the ice chute 32 to be dispensed by the dispenser 28.

Figure 4A:
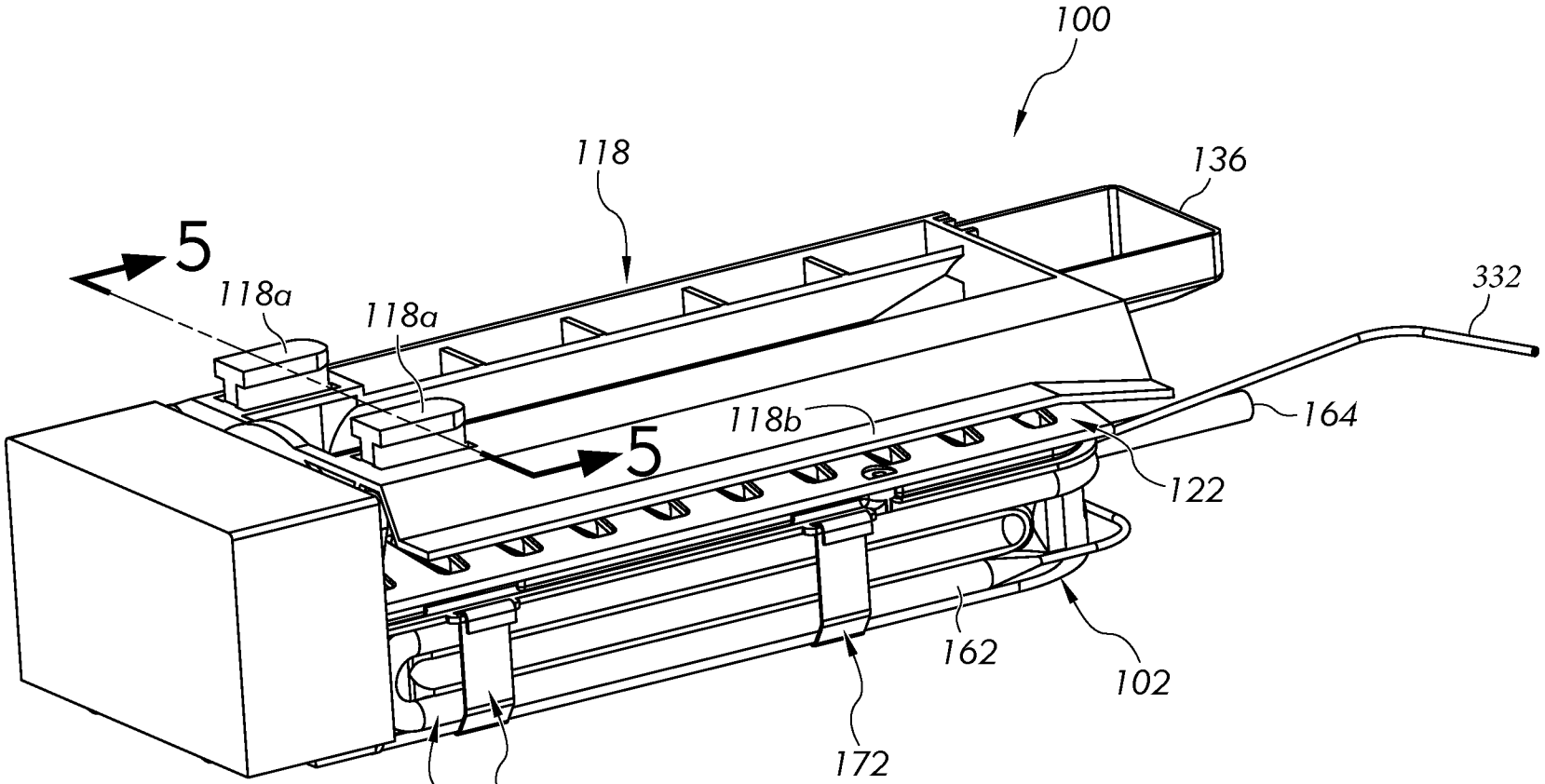
FIG. 4A is a side perspective view of a first embodiment an ice tray assembly for the ice maker of FIG. 3.
Figure 4B:
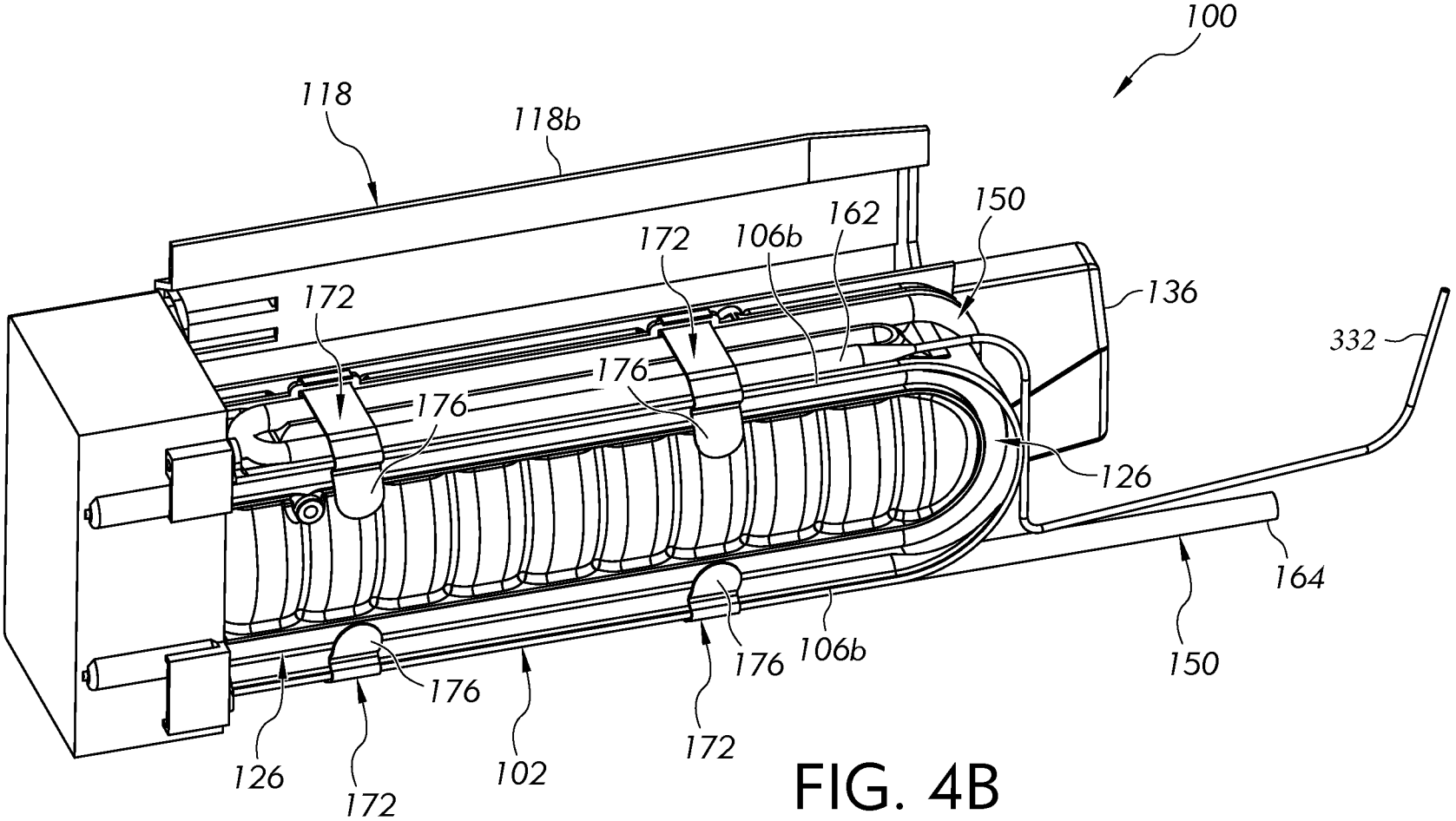
FIG. 4B is a bottom perspective view of the ice tray assembly of FIG. 4A.

Referring to FIGS. 4A and 4B, the ice tray assembly 100 includes an ice mold 102, a cover 118, a harvest heater 126 (FIGS. 4B and 5) for partially melting the ice pieces, a plurality of sweeper-arms 132 (FIG. 5) and an ice maker evaporator 150. The ice mold 102 is preferably made from a thermally conductive metal, like aluminum or steel. It is also preferred that the ice mold 102 is a single monolithic body.

The ice mold 102 includes at least one cavity 112 where water is frozen into ice, and the cavity 112 can be positioned variously depending upon the configuration of the ice mold. Referring to the example shown in FIG. 5, the ice mold 102 includes a top surface 104, a bottom surface 106 and lateral side surfaces 108. At least one cavity 112 is formed in the top surface 104 of the ice mold 102 where water is frozen into ice. In the shown embodiment, the ice mold 102 includes a plurality of cavities 112 that is configured for receiving water to be frozen into ice pieces. The plurality of cavities 112 may be defined by weirs 114, and some or all of the weirs 114 have an aperture therethrough to enable water to flow among the cavities 112. The cavities 112 can have multiple variants. Different cube shapes and sizes are possible (e.g., crescent, cubical, hemispherical, cylindrical, star, moon, company logo, a combination of shapes and sizes simultaneously, etc.) as long as the ice pieces can be removed by the plurality of sweeper-arms 132. In the embodiment shown, the plurality of cavities 112 are aligned in a lateral direction of the ice mold 102.

The bottom surface 106 of the ice mold 102 is contoured to receive the harvest heater 126, as described in detail below. The bottom surface 106 includes a groove 106*a* that extends about a periphery of the bottom surface 106 for receiving the harvest heater 126 therein.

The lateral side surfaces 108 are contoured or sculpted to receive the ice maker evaporator 150. The lateral side surfaces 108 may include elongated recesses 108*a* that closely match the outer profile of the ice maker evaporator 150, as described in detail below.

Figure 5:
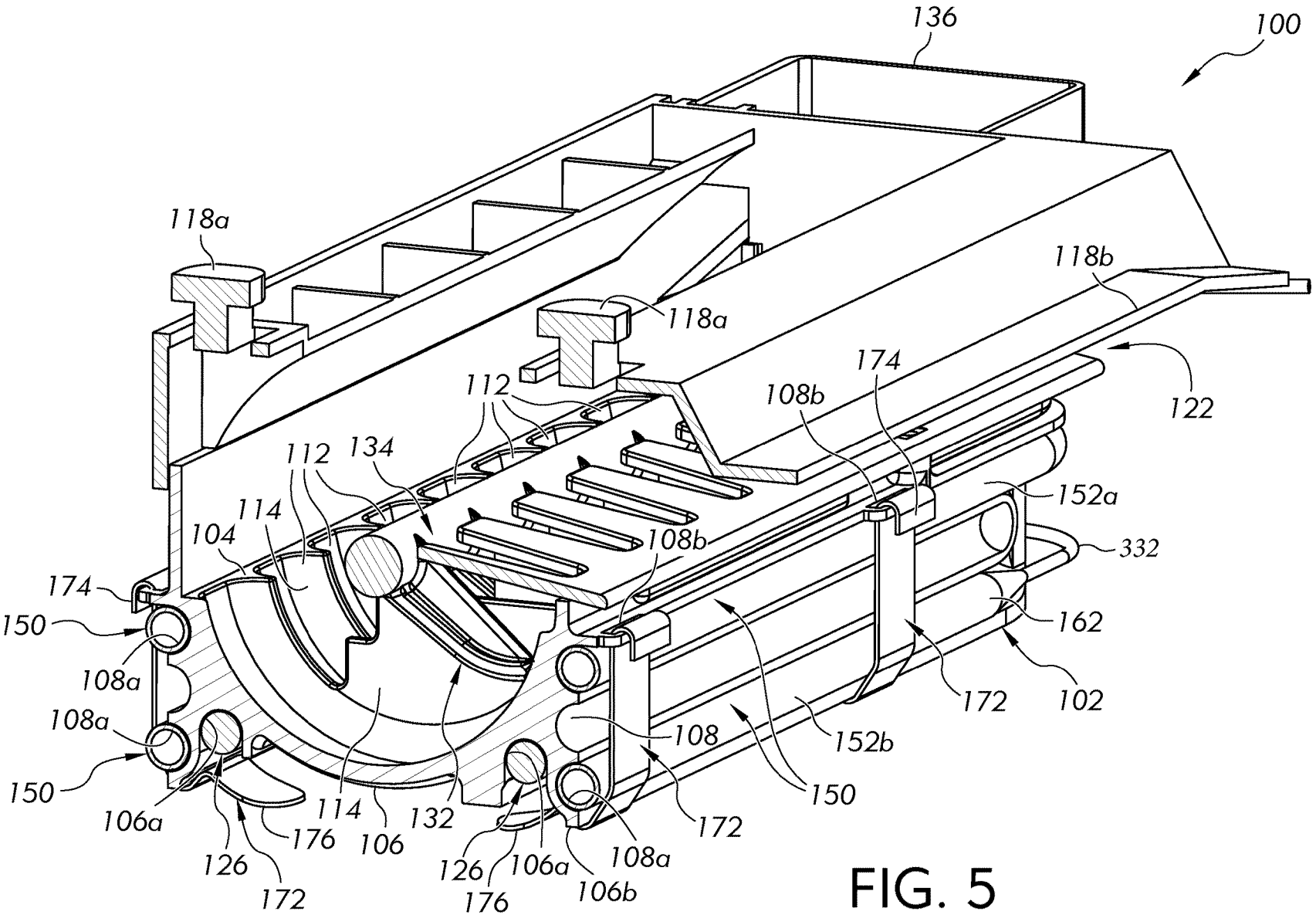
FIG. 5 is a section view of the ice tray assembly of FIG. 4A taken along line 5-5.

Referring to FIGS. 4A and 5, the cover 118 is attached to the top surface 104 of the ice mold 102 for securing the ice tray assembly 100 to the liner 34 of the fresh food compartment 24. The ice mold 102 may also be attached to an interior of the frame 52 of the ice maker 50 if installed as a unit. The cover 118 includes tabs 118*a* for securing the ice tray assembly 100 to mating openings (not shown) in the liner 34 or in a top wall of the frame 52. One longitudinal edge 118*b* of the cover 118 is dimensioned to be spaced from an upper edge of the ice mold 102 to define an opening 122. The opening 122 is dimensioned to allow ice pieces to be ejected from the ice tray assembly 100, as described in detail below.

Referring to FIGS. 4B and 5, the harvest heater 126 is attached to the bottom surface 106 of the ice mold 102 to provide a heating effect to the ice mold 102 to thereby separate congealed ice pieces from the ice mold 102 during an ice harvesting operation. The heater 126 may be an electric resistive heater, and may be capture in the groove 106*a* formed in the bottom surface 106 of the ice mold 102. The heater 126 is configured to be in direct or substantially direct contact with the ice mold 102 for increased conductive heat transfer. In the embodiment shown, the harvest heater 126 is a U-shape element that extends around a periphery of the bottom surface 106 and has a cylindrical outer surface. It is contemplated that the groove 106*a* may have a cylindrical contour that matches the outer cylindrical outer surface of the harvest heater 126. In the embodiment shown, the legs of the U-shaped heater 126 extend along the lateral direction of the ice mold 102. It is contemplated the heater 126 may have other shapes, for example, but not limited to, circular, oval, spiral, etc. so long as the heater 126 is disposed in direct or substantially direct contact with the ice mold 102.

The plurality of sweeper-arms 132 are disposed in the cavities 112 formed in the top surface 104 of the ice mold 102. The plurality of sweeper-arms 132 are elongated elements that are attached to a rotatable shaft 134. As the shaft 134 rotates the sweeper-arms 132 move through the cavities 112 to force ice pieces in the cavities 112 out of the ice mold 102. In the embodiment shown in FIG. 5, the shaft 134 extends in the lateral direction of the ice mold 102 and is rotatable in a clockwise direction such that the sweeper-arms 132 force the ice pieces into an area above the ice mold 102. A lower surface of the cover 118 is curved to direct the ice pieces toward the opening 122 between the cover 118 and the ice mold 102. As the sweeper-arms 132 continue to rotate, the ice pieces are then ejected from the ice tray assembly 100 into the ice bin 54 (FIG. 3) positioned below the ice tray assembly 100.

Prior to actuating the plurality of sweeper-arms 132, the harvest heater 126 is energized to heat the ice mold 102 which, in turn, melts a lower surface of the ice pieces in the plurality of cavities 112. A thin layer of liquid is formed on the lower surface of the ice pieces to aid in detaching the ice pieces from the ice mold 102. The plurality of sweeper-arms 132 may then eject the ice pieces out of the ice mold 102.

In the embodiment shown, the ice mold 102 is a monolithic body that includes an integrally formed water fill cup 136. It is contemplated that the water fill cup 136 may be made of the same material as the ice mold 102. In particular, it is contemplated that the ice mold 102 may be made of a metal material, e.g., aluminum or steel. The fill cup 136 includes side and bottom walls that are planar and sloped toward the cavities 112 in the ice mold 102. As such, water injected into the fill cup 136 will flow, by gravity to the cavities 112 in the ice mold 102. It is contemplated that the thermal energy provided by the harvest heater 126 may also be sufficient to melt frost or ice that may accumulate on the fill cup 136 during normal operation.

Figure 6:
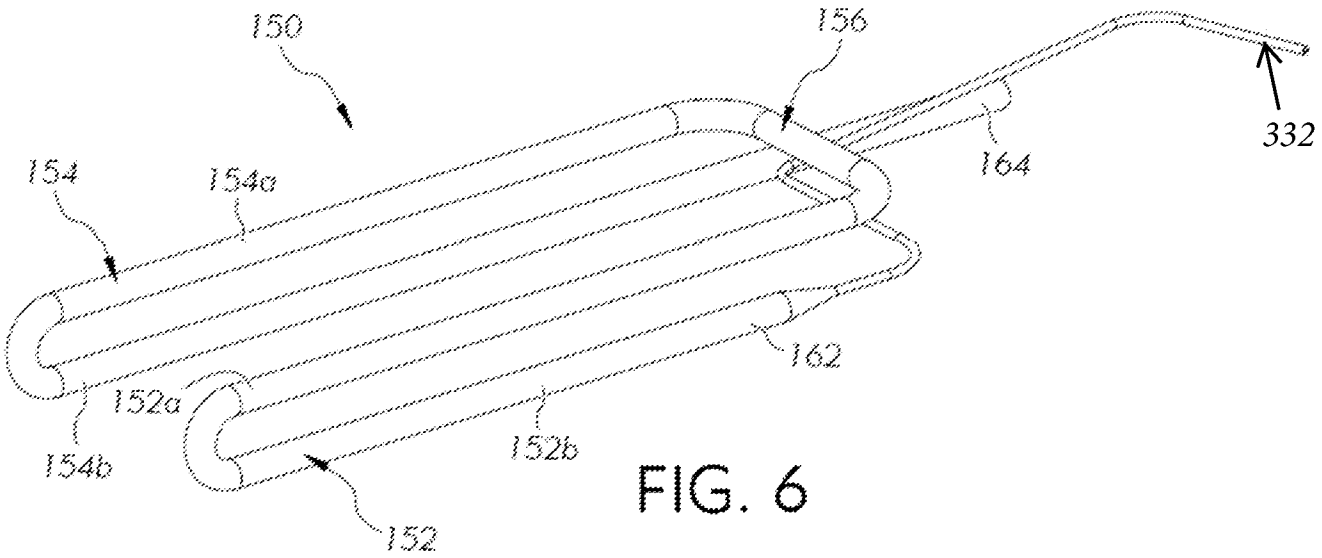
FIG. 6 is a side perspective view of an ice maker evaporator for the ice tray assembly of FIG. 4.

Referring to FIG. 6, the ice maker evaporator 150 includes a first leg 152, a second leg 154 and a connecting portion 156. In the embodiment shown, the first leg 152 is U-shaped and includes an upper portion 152*a* and a lower portion 152*b*. Similarly, the second leg 154 is U-shaped and includes an upper portion 154*a* and a lower portion 154*b*. The upper portions 152*a*, 154*a* and the lower portions 152*b*, 154*b* are illustrated in FIG. 6 as straight elongated elements that extend along the lateral direction of the ice mold 102. It is contemplated that these portions 152*a*, 154*a*, 152*b*, 154*b* can have other shapes, e.g., curved, wavy, tooth-shaped, stepped, etc. so long as these portions 152*a*, 154*a*, 152*b*, 154*b* are in intimate or surface-to-surface contact with the respective lateral side surfaces 108 of the ice mold 102. In the embodiment shown, the ice maker evaporator 150 has a U-shape. It is contemplated that the ice maker evaporator 150 may have other shapes so long as the ice maker evaporator 150 is in intimate contact with the ice mold 102.

The ice maker evaporator 150 includes an inlet end 162 for allowing a refrigerant to be injected into the ice maker evaporator 150 and an outlet end 164 for allowing the refrigerant to exit the ice maker evaporator 150. A first capillary tube 332 (described in detail below) is attached to the inlet end 162.

Referring to FIG. 5, in the embodiment shown, the ice maker evaporator 150 has a cylindrical outer surface and the respective recesses 108*a* formed in the lateral side surfaces 108 of the ice mold 102 have a matching contour. In the embodiment shown, the recesses 108*a* are contoured to preferably contact at least half or 180° of the cylindrical outer surface of the first and second legs 152, 154 of the ice maker evaporator 150. It is contemplated that the amount of contact may be more or less than half or 180°.

Retention clips 172 are provided for applying a retaining force to the ice maker evaporator 150 for securing the ice maker evaporator 150 into both lateral side surfaces 108 of the ice mold 102. In the embodiment shown, the clips 172 include an upper end 174 that is shaped for engaging a slotted opening 108*b* in the lateral side surface 108 of the ice mold 102. A lower end 176 of the clip 172 is shaped for allowing the clip 172 to attach to the bottom surface 106 of the ice mold 102. In the embodiment shown, the upper end 174 is J-shaped for securing the clip 172 to the slotted opening 108*b* and the lower end 176 is S-shaped to attach the clip 172 to an elongated rib 106*b* extending along opposite edges of the bottom surface 106 of the ice mold 102. The clip 172 is installed by inserting the upper end 174 into the slotted opening 108*b* and then rotating the clip 172 toward the ice mold 102 until the lower end 176 snaps or clips onto the elongated rib 106*b*, or an equivalent feature of the ice mold 102. The clips 172 are dimensioned and positioned to bias or maintain the ice maker evaporator 150 in intimate contact or abutment with the lateral side surfaces 108 of the ice mold 102. It is contemplated that the ice maker evaporator 150 may be configured to snap into the respective recesses 108*a* on the lateral side surfaces 108 of the ice mold 102.

The ice tray assembly 100 of the instant application employs a direct cooling approach, in which the ice maker evaporator 150 is in direct (or substantially direct) contact with the ice mold 102. The ice pieces are made without cold air ducted from a remote location (e.g., a freezer) to create or maintain the ice. It is understood that direct contact is intended to mean that the ice maker evaporator 150 abuts the ice mold 102.

Figure 7:
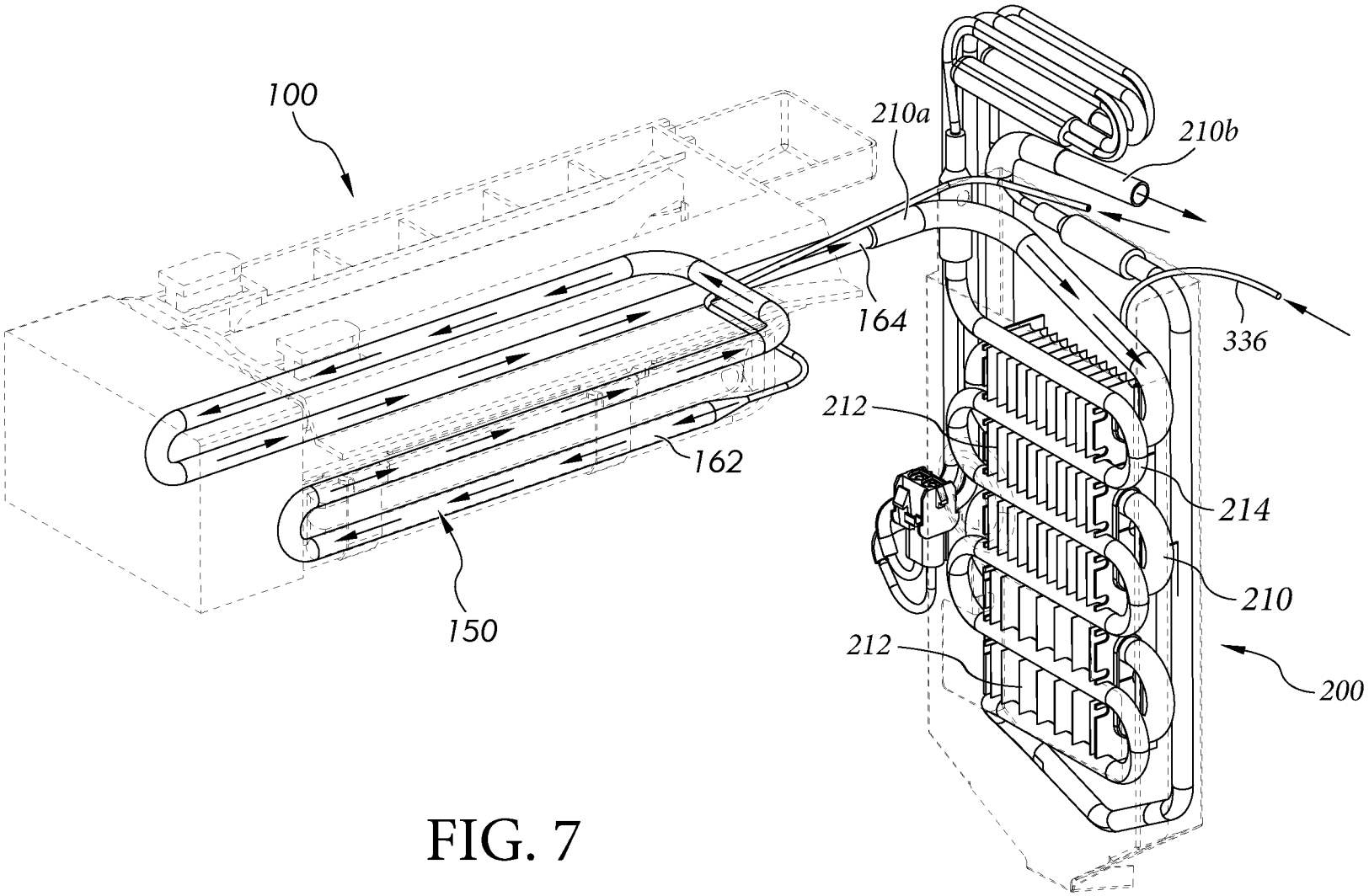
FIG. 7 is a side perspective view of the ice maker evaporator of FIG. 6 and an ice box evaporator assembly illustrating an example flow path of a refrigerant through the ice maker evaporator and the ice box evaporator assembly.

Referring to FIG. 7, the air handler 70 includes an ice box evaporator assembly 200 that is connected to the ice maker evaporator 150. The ice box evaporator assembly 200 includes an ice box evaporator tube 210 and a defrost element 214. The ice box evaporator tube 210 has an inlet 210*a* where a refrigerant enters and an outlet 210*b* where the refrigerant exits the ice box evaporator tube 210. The ice box evaporator tube 210 is formed to include several hair-pin or U-shaped bends and to pass through a plurality of fins 212. The fins 212 are configured to improve the efficiency in removing heat from air passing over the ice box evaporator tube 210. The defrost element 214 is positioned adjacent the ice box evaporator tube 210 for defrosting the same, when desired.

Still, although the term "evaporator" is used for simplicity, in yet another embodiment the ice maker evaporator 150 and ice box evaporator tube 210 could instead be a thermoelectric element (or other cooling element) that is operable to cool the ice mold 102 and the air flowing through the air handler 70, respectively, to a sufficient temperature to maintain the ice pieces in the ice mold 102 and the ice bin 54 in a frozen condition.

Figure 8:
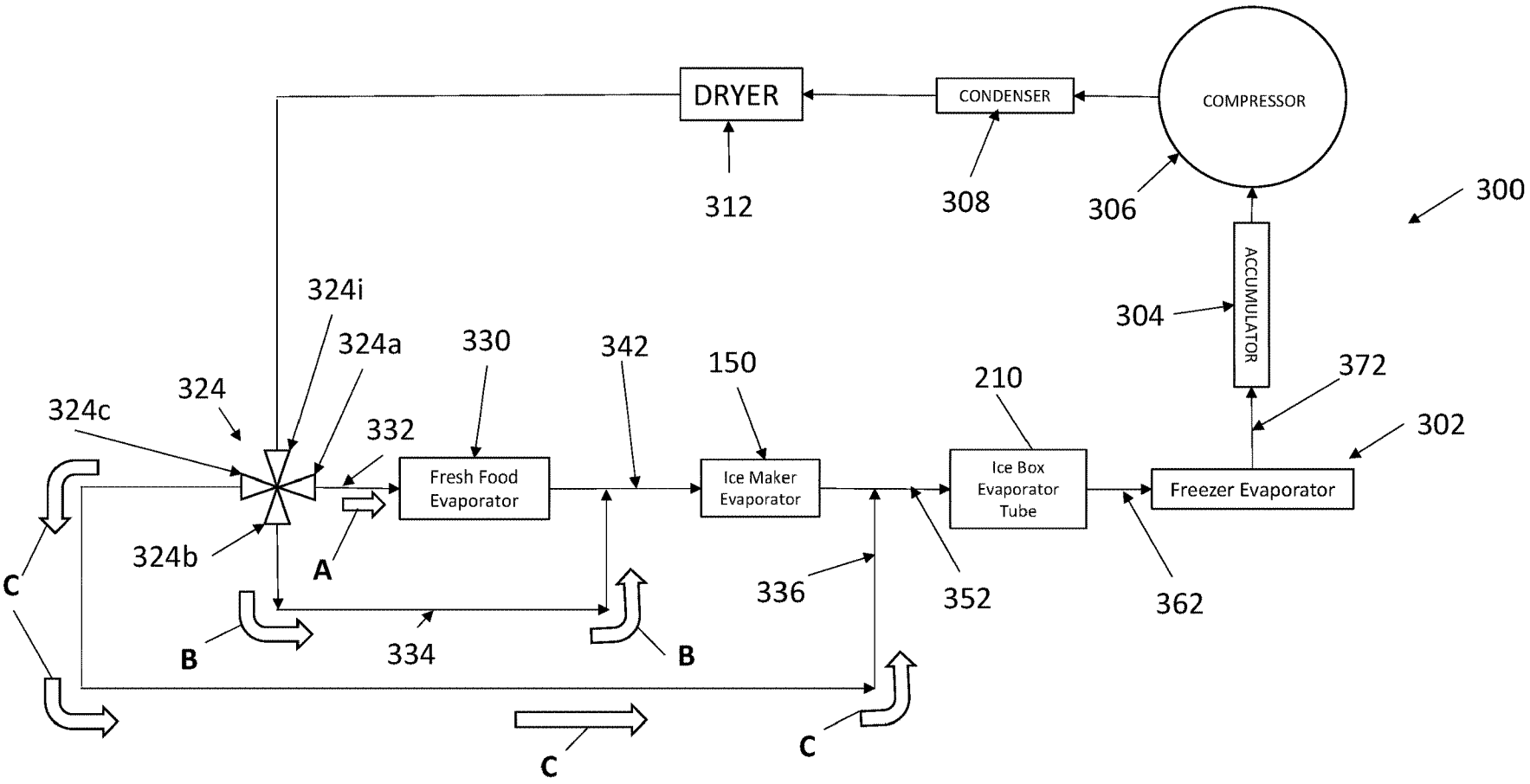
FIG. 8 is a schematic of a cooling system for the refrigerator of FIG. 1.

Referring to FIG. 8, a schematic of a cooling system 300 for the refrigerator 20 is shown. The cooling system 300 includes conventional components, such as a freezer evaporator 302, an accumulator 304 (optional), a compressor 306, a condenser 308 and a dryer 312. These components are conventional components that are well known to those skilled in the art and will not be described in detail herein.

A stepper valve 324 is connected to an outlet of the dryer 312. It is contemplated that both the valve 324 and the dryer 312 may be positioned in a machine room (not shown) of the refrigerator 20. The stepper valve 324 includes a single inlet 324*i* and three outlets 324*a*, 324*b*, 324*c*. The inlet 324*i* is connected to the condenser 308 and optionally to the dryer 312. The first outlet 324*a* is connected to a fresh food evaporator 330 for the fresh food compartment 24 via a first capillary tube 332. The second outlet 324*b* of the stepper valve 324 is connected via a second capillary tube 334 to a first line 342 that connects an outlet of the fresh food evaporator 330 to the inlet end 162 (FIG. 7) of the ice maker evaporator 150. The third outlet 324*c* of the stepper valve 324 is connected via a third capillary tube 336 to a second line 352 that connects the outlet end 164 (FIG. 7) of the ice maker evaporator 150 to the inlet 210*a* (FIG. 7) of the ice box evaporator tube 210.

The outlet 210*b* (FIG. 7) of the ice box evaporator tube 210 is connected via a third line 362 to an inlet of the freezer evaporator 302 for the freezer compartment 22. An outlet of the freezer evaporator 302 is connected via a fourth line 372 to an inlet of the accumulator 304.

When the valve 324 is in a first position (i.e., in through the inlet 324*i* and out through the first outlet 324*a*) the refrigerant flows along the flow path "A" through the first capillary tube 332, through the fresh food evaporator 330 and enters the inlet end 162 (FIG. 7) of the ice maker evaporator 150, flows through the ice maker evaporator 150, exits the outlet end 164 (FIG. 7), enters the inlet 210*a* (FIG. 7) of the ice box evaporator tube 210, flows through the ice box evaporator tube 210, exits the outlet 210*b* (FIG. 7) of the ice box evaporator tube 210 and flows through the freezer evaporator 302 before returning to the accumulator 304.

When the valve 324 is in a second position (i.e., in through the inlet 324*i* and out through the second outlet 324*b*), the refrigerant flows along the flow path "B" through the second capillary tube 334 enters the inlet end 162 (FIG. 7) of the ice maker evaporator 150, flows through the ice maker evaporator 150, exits the outlet end 164 (FIG. 7), enters the inlet 210*a* (FIG. 7) of the ice box evaporator tube 210, flows through the ice box evaporator tube 210, exits the outlet 210*b* (FIG. 7) of the ice box evaporator tube 210 and flows through the freezer evaporator 302 before returning to the accumulator 304. As such, when the valve 324 is in the second position the refrigerant bypasses the fresh food evaporator 330.

When the valve 324 is in a third position (i.e., in through the inlet 324*i* and out through the third outlet 324*c*), the refrigerant flows along the flow path "C" through the third capillary tube 336 enters the inlet 210*a* (FIG. 7) of the ice box evaporator tube 210, flows through the ice box evaporator tube 210, exits the outlet 210*b* (FIG. 7) of the ice box evaporator tube 210 and flows through the freezer evaporator 302 before returning to the accumulator 304. As such, when the valve 324 is in the third position the refrigerant bypasses the fresh food evaporator 330 and the ice maker evaporator 150.

During an ice harvesting process, a full bucket mode (i.e., the ice bucket is full and cannot accept more ice), or when the ice maker 50 is "OFF," the valve 324 is in the third position such that the third outlet 324*c* is fluidly connected to the ice box evaporator tube 210 and the refrigerant bypasses the fresh food evaporator 330 and the ice maker evaporator 150. During other processes/modes of operation wherein the temperature of the fresh food compartment 24 is at or below a target temperature, the valve 324 is in the second position such that the second outlet 324*b* is fluidly connected to the ice maker evaporator 150 and the refrigerant bypasses the fresh food evaporator 330. During other processes/modes of operation wherein the temperature of the fresh food compartment 24 is above a target temperature, the valve 324 is in the first position such that the first outlet 324*a* of the valve 324 is connected to the fresh food evaporator 330 and none of the evaporators of the cooling system 300 are bypassed.

In the embodiment illustrated in FIG. 8, the fresh food evaporator 330, the ice maker evaporator 150, the ice box evaporator tube 210 and the freezer evaporator 302 are all disposed in series, in that order. As described in detail above, the cooling system 300 is configured such the stepper valve 324 selectively directs a refrigerant through: 1) all four evaporators 330, 150, 210, 302 in the series, 2) through only the last three evaporators 150, 210, 302 in the series, or 3) through only the last two evaporators 210, 302 in the series.

Figure 9:
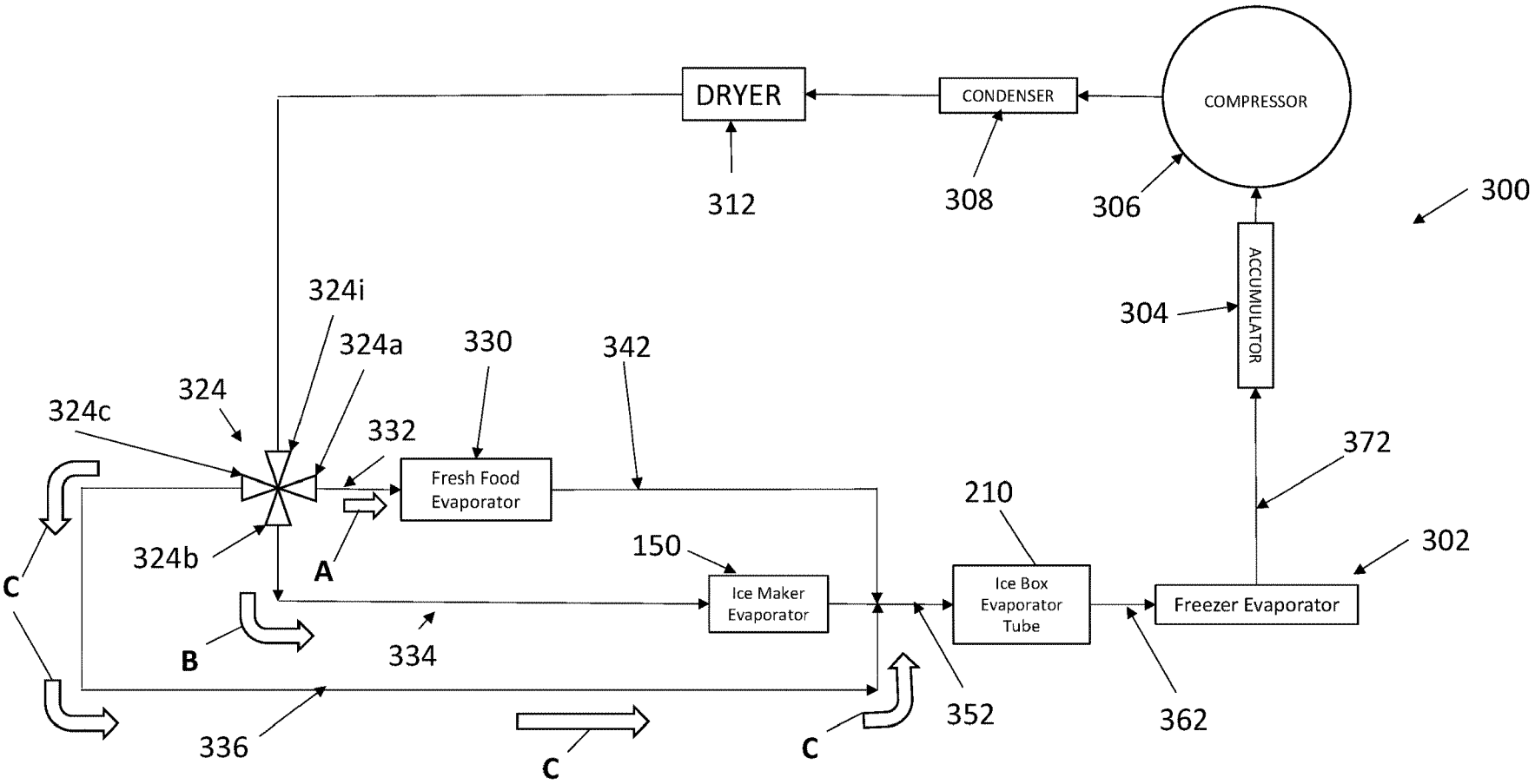
FIG. 9 is a schematic of a second embodiment cooling system for the refrigerator of FIG. 1.

FIG. 9 illustrates a second embodiment wherein only the ice maker evaporator 150, the ice box evaporator tube 210 and the freezer evaporator 302 are disposed in series in a path and this path is parallel to a path wherein the fresh food evaporator 330 is disposed. The fresh food evaporator 330 is connected to the first outlet 324*a* of the stepper valve 324 by the first capillary tube 332 and the fresh food evaporator 330 is connected to the second line 352 that connects the ice maker evaporator 150 to the ice box evaporator tube 210 by the first line 342.

The inlet end 162 (FIG. 7) of the ice maker evaporator 150 is connected to the second outlet 324*b* of the stepper valve 324 by the second capillary tube 334 and the outlet end 164 of the ice maker evaporator 150 is connected to the inlet 210*a* of the ice box evaporator tube 210 by the second line 352.

The second line 352 is connected to the third outlet 324*c* of the stepper valve 324 by the third capillary tube 336. The outlet 210*b* of the ice box evaporator tube 210 is connected by line 362 to the freezer evaporator 302 which, in turn, is connected to the accumulator 304 by the fourth line 372.

When the valve 324 is in a first position (i.e., in through the inlet 324*i* and out through the first outlet 324*a*) the refrigerant flows along the flow path "A" through the first capillary tube 332 and the fresh food evaporator 330. Upon exiting the fresh food evaporator 330, the refrigerant flows through the second line 352, enters the inlet 210*a* of the ice box evaporator tube 210, flows through the ice box evaporator tube 210, exits through the outlet 210*b* of the ice box evaporator tube 210 and flows through the freezer evaporator 302 before returning to the accumulator 304. As such, when the valve 324 is in the first position the refrigerant bypasses the ice maker evaporator 150.

When the valve 324 is in a second position (i.e., in through the inlet 324*i* and out through the second outlet 324*b*), the refrigerant flows along the flow path "B" through the second capillary tube 334, enters the inlet end 162 of ice maker evaporator 150 and flows through the ice maker evaporator 150. Upon exiting the outlet end 164 of the ice maker evaporator 150, the refrigerant flows through the second line 352, enters the inlet 210*a* of the ice box evaporator tube 210, flows through the ice box evaporator tube 210, exits through the outlet 210*b* of the ice box evaporator tube 210 and flows through the freezer evaporator 302 before returning to the accumulator 304. As such, when the valve 324 is in the second position the refrigerant bypasses the fresh food evaporator 330.

When the valve 324 is in a third position (i.e., in through the inlet 324*i* and out through the third outlet 324*c*), the refrigerant flows along the flow path "C" through the third capillary tube 336, through the second line 352, enters the inlet 210*a* of the ice box evaporator tube 210, flows through the ice box evaporator tube 210, exits through the outlet 210*b* of the ice box evaporator tube 210 and flows through the freezer evaporator 302 before returning to the accumulator 304. As such, when the valve 324 is in the third position the refrigerant bypasses both the ice maker evaporator 150 and the fresh food evaporator 330.

During an ice harvesting process, a full bucket mode (i.e., the ice bucket is full and cannot accept more ice), or when the ice maker 50 is "OFF" and the temperature of the fresh food compartment 24 is at or above a desired temperature, the valve 324 is in the first position such that the first outlet 324*a* is fluidly connected to the fresh food evaporator 330 and the refrigerant bypasses the ice maker evaporator 150. During an ice harvesting process, a full bucket mode, or when the ice maker 50 is "OFF" and the temperature of the fresh food compartment is below the desired temperature, the valve 324 is in the third position such that the third outlet 324*c* is fluidly connected to the ice box evaporator tube 210 and the refrigerant bypasses the ice maker evaporator 150 and the fresh food evaporator 330. During other processes/modes of operation, the valve 324 is in the second position such that the second outlet 324*b* of the valve 324 is connected to the ice maker evaporator 150 and bypasses the fresh food evaporator 330.

The switching of the valve 324 is designed to reduce the operational cost of the cooling system 300 for the ice maker 50. For simplicity, the housing of the air handler assembly 70 is not shown in FIG. 7. Arrows in FIG. 7 illustrate that path of the refrigerant through the ice maker evaporator 150 and the ice box evaporator tube 210.

Figure 10:
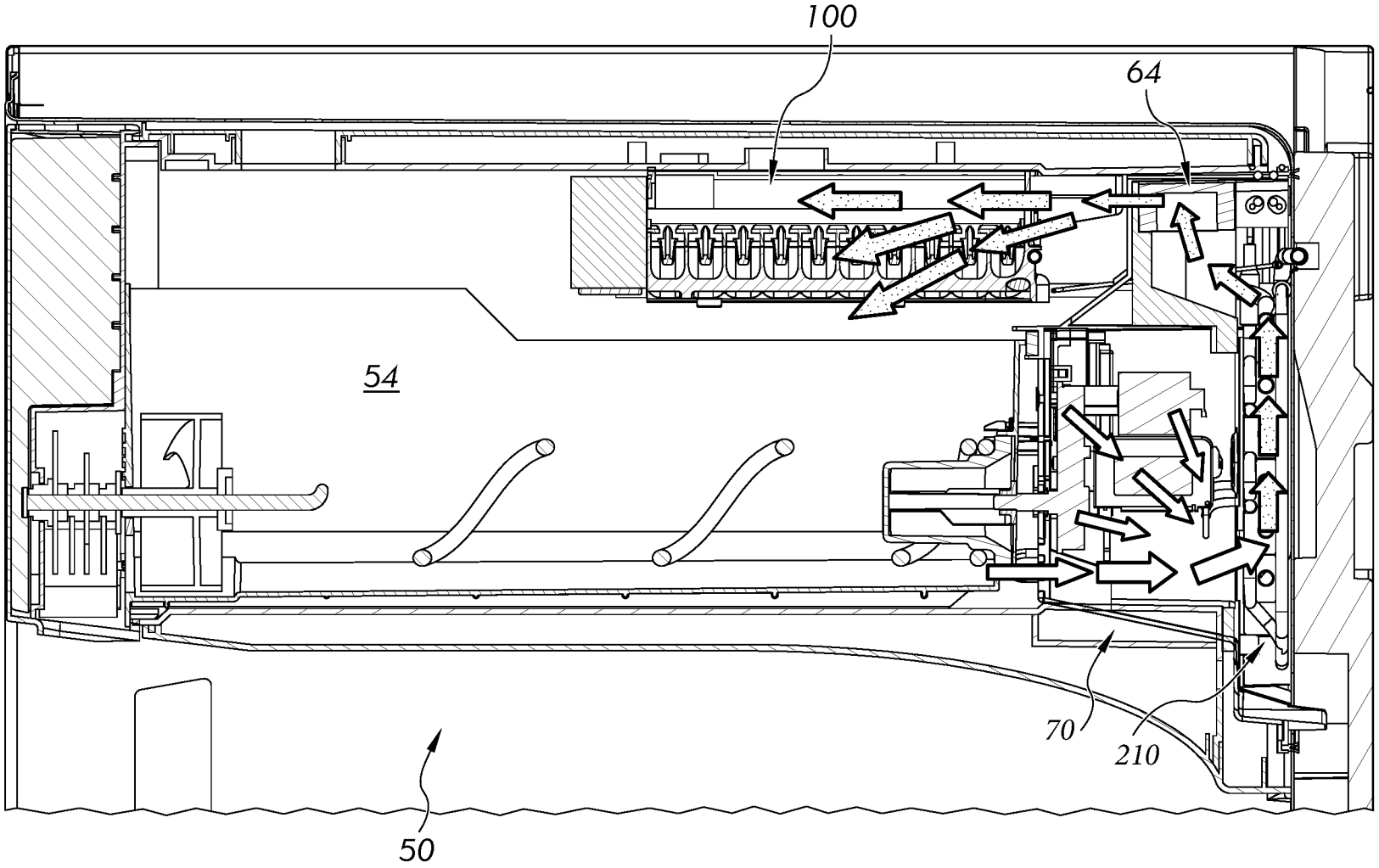
FIG. 10 is a side section view taken along line 10-10 of FIG. 3.

Referring to FIG. 10, the ice maker 50 includes a circulation fan 64. The ice box evaporator tube 210 is disposed proximate the circulation fan 64 such that air is drawn from the ice bin 54, over the ice box evaporator tube 210 and back to the ice bin 54. It is contemplated that the circulation fan 64 may be a centrifugal or squirrel-cage type fan wherein air is drawn into a center of the fan 64 and then exhausted radially away from the fan. It is also contemplated that the circulation fan 64 may be an axial fan wherein air is conveyed through the fan along a rotational axis of the fan. It is contemplated that the ice box evaporator tube 210 may include a defrost element 214 (FIG. 7) that may be energized during a defrost cycle of the ice box evaporator tube 210. The defrost element 214 may be configured such that heat generated by the defrost element 214 is sufficient to defrost both the ice box evaporator tube 210 and the fill cup 136 (FIG. 5) of the ice tray assembly 100.

In addition or alternatively, the ice maker of the present application may further be adapted to mounting and use on a freezer door. In this configuration, although still disposed within the freezer compartment, at least the ice maker (and possibly an ice bin) is mounted to the interior surface of the freezer door. It is contemplated that the ice mold and ice bin can be separated elements, in which one remains within the freezer cabinet and the other is on the freezer door.

Cold air can be ducted to the freezer door from an evaporator in the fresh food or freezer compartment, including the system evaporator. The cold air can be ducted in various configurations, such as ducts that extend on or in the freezer door, or possibly ducts that are positioned on or in the sidewalls of the freezer liner or the ceiling of the freezer liner. In one example, a cold air duct can extend across the ceiling of the freezer compartment, and can have an end adjacent to the ice maker (when the freezer door is in the closed condition) that discharges cold air over and across the ice mold. If an ice bin is also located on the interior of the freezer door, the cold air can flow downwards across the ice bin to maintain the ice pieces at a frozen state. The cold air can then be returned to the freezer compartment via a duct extending back to the evaporator of the freezer compartment. A similar ducting configuration can also be used where the cold air is transferred via ducts on or in the freezer door. The ice mold can be rotated to an inverted state for ice harvesting (via gravity or a twist-tray) or may include a sweeper-finger type, and a heater can be similarly used. It is further contemplated that although cold air ducting from the freezer evaporator as described herein may not be used, a thermoelectric chiller or other alternative chilling device or heat exchanger using various gaseous and/or liquid fluids could be used in its place. In yet another alternative, a heat pipe or other thermal transfer body can be used that is chilled, directly or indirectly, by the ducted cold air to facilitate and/or accelerate ice formation in the ice mold. Of course, it is contemplated that the ice maker of the instant application could similarly be adapted for mounting and use on a freezer drawer.

Alternatively, it is further contemplated that the ice maker of the instant application could be used in a fresh food compartment, either within the interior of the cabinet or on a fresh food door. It is contemplated that the ice mold and ice bin can be separated elements, in which one remains within the fresh food cabinet and the other is on the fresh food door.

In addition or alternatively, cold air can be ducted from another evaporator in the fresh food or freezer compartment, such as the system evaporator. The cold air can be ducted in various configurations, such as ducts that extend on or in the fresh food door, or possibly ducts that are positioned on or in the sidewalls of the fresh food liner or the ceiling of the fresh food liner. In one example, a cold air duct can extend across the ceiling of the fresh food compartment, and can have an end adjacent to the ice maker (when the fresh food door is in the closed condition) that discharges cold air over and across the ice mold. If an ice bin is also located on the interior of the fresh food door, the cold air can flow downwards across the ice bin to maintain the ice pieces at a frozen state. The cold air can then be returned to the fresh food compartment via a ducting extending back to the compartment with the associated evaporator, such as a dedicated icemaker evaporator compartment or the freezer compartment. A similar ducting configuration can also be used where the cold air is transferred via ducts on or in the fresh food door. The ice mold can be rotated to an inverted state for ice harvesting (via gravity or a twist-tray) or may include a sweeper-finger type, and a heater can be similarly used. It is further contemplated that although cold air ducting from the freezer evaporator (or similarly a fresh food evaporator) as described herein may not be used, a thermoelectric chiller or other alternative chilling device or heat exchanger using various gaseous and/or liquid fluids could be used in its place. In yet another alternative, a heat pipe or other thermal transfer body can be used that is chilled, directly or indirectly, by the ducted cold air to facilitate and/or accelerate ice formation in the ice mold. Of course, it is contemplated that the ice maker of the instant application could similarly be adapted for mounting and use on a fresh food drawer.

The invention has been described with reference to the example embodiments described above. Modifications and alterations will occur to others upon a reading and understanding of this specification. Examples embodiments incorporating one or more aspects of the invention are intended to include all such modifications and alterations insofar as they come within the scope of the appended claims.

What is claimed is:

1. A refrigeration appliance comprising:

a fresh food compartment for storing food items in a refrigerated environment having a target temperature above 0° C.;

a freezer compartment for storing food items in a sub-freezing environment having a target temperature below 0° C.; and an ice maker disposed within the fresh food compartment for freezing water into ice pieces, the ice maker comprising:

an ice mold comprising at least one cavity formed therein for making the ice pieces;

an ice maker evaporator for cooling the ice mold to a temperature below 0° C. via thermal conduction; and a cooling system comprising:

a fresh food evaporator, an ice box evaporator tube and a freezer evaporator both disposed in series with the ice maker evaporator, and a valve comprising:

an inlet;

a first outlet connected to an inlet of the fresh food evaporator;

a second outlet connected to an inlet of the ice maker evaporator; and a third outlet connected to an inlet of the ice box evaporator tube, wherein the inlet of the valve is connected to the first outlet of the valve when the valve is in a first position such that a refrigerant flows through the fresh food evaporator, the ice box evaporator tube and the freezer evaporator, in that order, wherein the inlet of the valve is connected to the second outlet of the valve when the valve is in a second position such that the refrigerant flows through the ice maker evaporator, the ice box evaporator tube and the freezer evaporator, in that order, and wherein the inlet of the valve is connected to the third outlet of the valve when the valve is in a third position such that the refrigerant flows through the ice box evaporator tube and the freezer evaporator, in that order.

2. The refrigeration appliance of claim 1, wherein the ice maker evaporator abuts at least one lateral side surface of the ice mold.

3. The refrigeration appliance of claim 1, wherein when the valve is in the third position, a refrigerant line fluidly communicates with a line connecting the ice maker evaporator to the ice box evaporator tube at a location upstream of the ice box evaporator tube.

4. The refrigeration appliance of claim 1, wherein when the valve is in the first position the fresh food evaporator fluidly communicates with a line connecting the ice maker evaporator to the ice box evaporator tube at a location upstream of the ice box evaporator tube.

5. The refrigeration appliance of claim 1, wherein the valve is a stepper valve.

6. A cooling system for a refrigeration appliance comprising:

a first evaporator for cooling water to a temperature below 0° C. via thermal conduction; and a second evaporator, a third evaporator and a fourth evaporator both disposed in series with the first evaporator, and a valve comprising:

an inlet;

a first outlet connected to an inlet of the second evaporator;

a second outlet fluidly connected to an inlet of the first evaporator; and a third outlet connected to an inlet of the third evaporator, wherein the inlet of the valve is connected to the first outlet of the valve when the valve is in a first position such that a refrigerant flows through the second evaporator, the third evaporator and the fourth evaporator, in that order, wherein the inlet of the valve is connected to the second outlet of the valve when the valve is in a second position such that the refrigerant flows through the first evaporator, the third evaporator and the fourth evaporator, in that order, but not through the second evaporator, and wherein the inlet of the valve is connected to the third outlet of the valve when the valve is in a third position such that the refrigerant flows through the third evaporator and the fourth evaporator, in that order, but not through the first evaporator and the second evaporator.

7. The cooling system according to claim 6, wherein the first evaporator is an ice maker evaporator.

8. The cooling system according to claim 6, wherein the second evaporator is a fresh food evaporator for a fresh food compartment, the fresh food compartment for storing food items in a refrigerated environment having a target temperature above 0° C.

9. The cooling system according to claim 6, wherein the third evaporator is an ice box evaporator tube.

10. The cooling system according to claim 6, wherein the fourth evaporator is a freezer evaporator for a freezer compartment, the freezer compartment for storing food items in a sub-freezing environment having a target temperature below 0° C.

11. The cooling system of claim 6, wherein the valve is a stepper valve.

12. The cooling system of claim 6, wherein the second evaporator is in series with the third evaporator and the fourth evaporator.

13. The cooling system of claim 6, wherein the second outlet of the valve is connected to a refrigerant line that bypasses the second evaporator.

14. The cooling system of claim 13, wherein the first evaporator is disposed in the refrigerant line.

15. The cooling system of claim 13, wherein the refrigerant line connects to a second refrigerant line that connects an outlet of the second evaporator to an inlet of the third evaporator.

* * * * *